US010669816B2

(12) United States Patent
Deolalikar et al.

(10) Patent No.: US 10,669,816 B2
(45) Date of Patent: Jun. 2, 2020

(54) DOWNHOLE COMPONENT CONTROL ASSEMBLY

(71) Applicant: Halliburton Energy Services, Inc., Houston, TX (US)

(72) Inventors: Neelesh Deolalikar, Houston, TX (US); Ruchir Shirish Patwa, Tomball, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/766,223

(22) PCT Filed: Nov. 10, 2015

(86) PCT No.: PCT/US2015/059979

§ 371 (c)(1),
(2) Date: Apr. 5, 2018

(87) PCT Pub. No.: WO2017/082882

PCT Pub. Date: May 18, 2017

(65) Prior Publication Data

US 2018/0298729 A1 Oct. 18, 2018

(51) Int. Cl.

| | |
|---|---|
| ***E21B 34/06*** | (2006.01) |
| ***E21B 41/00*** | (2006.01) |
| ***E21B 47/12*** | (2012.01) |

(52) U.S. Cl.

CPC ..... *E21B 41/00* (2013.01); *E21B 34/06* (2013.01); *E21B 47/12* (2013.01)

(58) Field of Classification Search

CPC ..... E21B 41/00; E21B 34/06; E21B 34/12; E21B 34/14; E21B 47/12

See application file for complete search history.

(56) References Cited

U.S. PATENT DOCUMENTS

| | | | | |
|---|---|---|---|---|
| 5,398,713 | A | 3/1995 | Whitman | |
| 2004/0118608 | A1 | 6/2004 | Haci et al. | |
| 2012/0018172 | A1* | 1/2012 | Javed | E21B 34/14 166/382 |
| 2013/0025851 | A1 | 1/2013 | Laing et al. | |
| 2013/0032402 | A1 | 2/2013 | Byreddy et al. | |
| 2013/0313022 | A1* | 11/2013 | Kirkhope | E21B 4/02 175/104 |

(Continued)

FOREIGN PATENT DOCUMENTS

| | | |
|---|---|---|
| WO | 2007090034 | 8/2007 |

OTHER PUBLICATIONS

International Search Report and Written Opinion of PCT Application No. PCT/US2015/059979 dated Aug. 9, 2016: pp. 1-12.

*Primary Examiner* — Giovanna C Wright
*Assistant Examiner* — Yanick A Akaragwe
(74) *Attorney, Agent, or Firm* — Chamberlain Hrdlika

(57) ABSTRACT

A system for controlling a downhole component within a borehole, the system including a transfer assembly coupled between a rotatable component and the downhole component, the transfer assembly including a swash plate assembly configured to control the downhole component and a member configured to engage the swash plate assembly. The member is configured to move radially based upon a rotational speed of the rotatable component to selectively engage the swash plate assembly.

20 Claims, 9 Drawing Sheets

(56) References Cited

U.S. PATENT DOCUMENTS

| | | | | |
|---|---|---|---|---|
| 2015/0090459 | A1* | 4/2015 | Cain | B08B 7/0071 166/335 |
| 2015/0107899 | A1 | 4/2015 | Fisher, Jr. et al. | |
| 2016/0138396 | A1* | 5/2016 | Morgan | E21B 49/10 166/264 |

* cited by examiner

DOWNHOLE COMPONENT CONTROL ASSEMBLY

BACKGROUND

This section is intended to introduce the reader to various aspects of art that may be related to various aspects of the presently described embodiments. This discussion is believed to be helpful in providing the reader with background information to facilitate a better understanding of the various aspects of the described embodiments. Accordingly, it should be understood that these statements are to be read in this light and not as admissions of prior art.

In oil and gas industries, energy is needed downhole to perform operations and/or operate equipment. For example, electrical energy may be available from batteries or electric generators, fluid energy may be available from the flow of drilling mud, and mechanical energy may be available from rotation of the drill string.

BRIEF DESCRIPTION OF DRAWINGS

For a detailed description of the embodiments of the invention, reference will now be made to the accompanying drawings in which.

DETAILED DESCRIPTION

Figure 1:
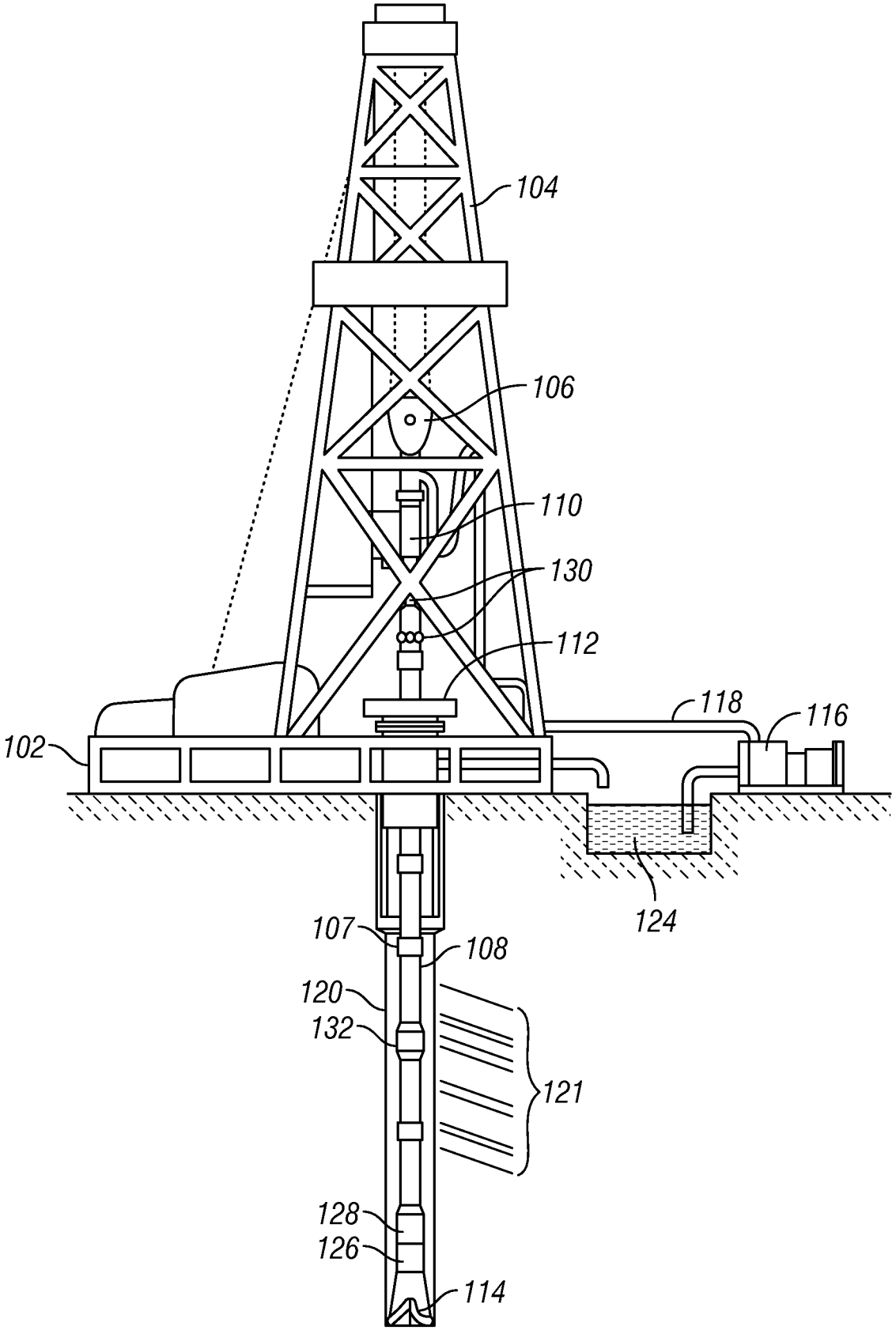
FIG. 1 depicts an example oilfield environment in accordance with one or more embodiments.

FIG. 1 depicts an example oilfield environment, according to one or more embodiments. As shown, a drilling platform 102 is equipped with a derrick 104 that supports a hoist 106 for raising and lowering a drill string 108. The hoist 106 suspends a top drive 110 that rotates the drill string 108 as the drill string is lowered through the well head 112. Sections of the drill string 108 are connected by threaded connectors 107. Connected to the lower end of the drill string 108 is a drill bit 114. As the drill bit 114 rotates, a borehole 120 is created that passes through various formations 121 within a reservoir. A pump 116 circulates drilling mud through a supply pipe 118 to the top drive 110, through the interior of drill string 108, through orifices in the drill bit 114, back to the surface via an annulus around the drill string 108, and into a retention pit 124. The drilling mud transports cuttings from the borehole 120 into the pit 124 and aids in maintaining the integrity of the borehole 120.

A tool 126 may be integrated into a bottom-hole assembly near the bit 114. The tool 126 may take the form of a drill collar, i.e., a thick-walled tubular that provides weight and rigidity to aid the drilling process, or may include one or more components known to those of skill in the art. For example, the tool may include one or more collars, valves, pistons, sensors, sleeves, and motors, among many other components. The tool 126 may also include, but is not limited to, logging while drilling (LWD) or measurement while drilling (MWD) tools, rotary steering tools, directional drilling tools, motors, reamers, hole-enlargers or stabilizers, among others. As the bit 114 extends the borehole 120 through the formations 121, the tool 126 may collect measurements of the borehole 120 and formations 121 around the tool 126, as well as measurements of the tool and/or component orientation and position, drilling mud properties, and various other drilling conditions. In one or more embodiments, the tool 126 may be a logging tool, an induction tool, or any other tool known to those of skill in the art.

Orientation measurements may be collected using an orientation indicator, which may include magnetometers, inclinometers, and/or accelerometers, though other sensor types such as gyroscopes may be used. In one or more embodiments, the tool 126 may include a magnetometer and an accelerometer. As is known in the art, the combination of those two sensor systems enables the measurement of the tool rotational angle ("toolface"), borehole inclination angle ("slope"), and compass direction ("azimuth"). In some embodiments, the toolface and borehole inclination angles are calculated from the accelerometer sensor output and the magnetometer sensor outputs may be used to calculate the borehole azimuth.

Downhole sensors, including the tool 126, may be coupled to a telemetry module 128 having a transmitter (e.g., acoustic telemetry transmitter) that transmits signals in the form of acoustic vibrations in a wall of drill string 108. A receiver array 130 may be coupled to tubing below the top drive 110 to receive transmitted signals. One or more repeater modules 132 may be optionally provided along the drill string to receive and retransmit the telemetry signals. Other telemetry techniques may be employed such as mud pulse telemetry, electromagnetic telemetry, and wired drill pipe telemetry, for example. Some telemetry techniques offer the ability to transmit commands between the surface to the tool 126, thereby enabling control of one or more components and operating parameters.

As discussed herein, examples of controlling a component and/or operating parameters may include moving a component (e.g., axially, radially, rotationally, etc.), actuating a component (e.g., opening and closing a valve, orienting a toolface of a drill bit, changing the transmission and/or reception direction of an antenna, etc.), adjusting an operating parameter (e.g., increasing and/or decreasing a rotational speed of a component, applying torque to a component, etc.), and/or any combination of the foregoing. It should be understood that other components and operations may be considered without departing from the scope of the present disclosure. For example, any of a collar, a sleeve, a drill bit, a sensor, a tool (density tool, logging tool, etc.), or the like may be controlled and any operating parameter such as weight on bit, steering direction, applied torque, or the like may be controlled in accordance with one or more embodiments.

Telemetry techniques offer the ability to transmit commands to control one or more components and may involve converting the command into an electrical signal and using the electrical signal along with an electronic control device to control one or more components and/or operating parameters. While electrical control is possible with certain equipment, there may be cases in which controlling one or more components and/or operating parameters may be performed using mechanical energy rather than through the use of an electrical signal or other electrical energy sources.

In one or more embodiments, control of a downhole component and/or operating parameter may be performed using mechanical energy from a drive shaft, such as the drill string 108 in FIG. 1. For example, the component and/or operating parameter may be controlled based upon a rotational speed of the drill string. In one or more embodiments, mechanical energy of the drill string may control a component using a transfer assembly coupled to the drill string and configured to control the component and/or operating parameter.

One or more embodiments include controlling a downhole component using a control assembly. The control assembly may be configured to engage with an annular member of a collar assembly. The collar assembly may be coupled to a drill string and the annular member may selectively engage with the control assembly based upon a rotational speed of the drill string.

FIGS. 2A-2F depict example systems 200 for controlling a downhole component 202 within a borehole (such as borehole 120 in FIG. 1) in accordance with one or more embodiments. The systems 200 include an optional housing 201, which may be stationary and/or coupled to the component 202, and a transfer assembly 204 coupled to a drill string 206 and the component 202. In one or more embodiments, the housing 201 may be a casing section within the borehole and may be indirectly coupled to the component 202 with a bearing 203 (e.g., a rolling-element bearing, a fluid bearing, a magnetic bearing, etc.). The housing 201 may also be directly coupled to the transfer assembly 204 or indirectly coupled to the transfer assembly 204 with bearings 205 (e.g., a rolling-element bearing, a fluid bearing, a magnetic bearing, etc.). In one or more embodiments, the component 202 and the optional housing 201 may be a portion of or integral with the component 202.

As shown, the drill string 206 is configured to rotate about axis 208 and is engaged with the transfer assembly 204. The transfer assembly 204 utilizes mechanical energy from the drill string 206 (e.g., a rotational speed of the drill string) to control the downhole component 202, as will be described below.

Figure 2A:
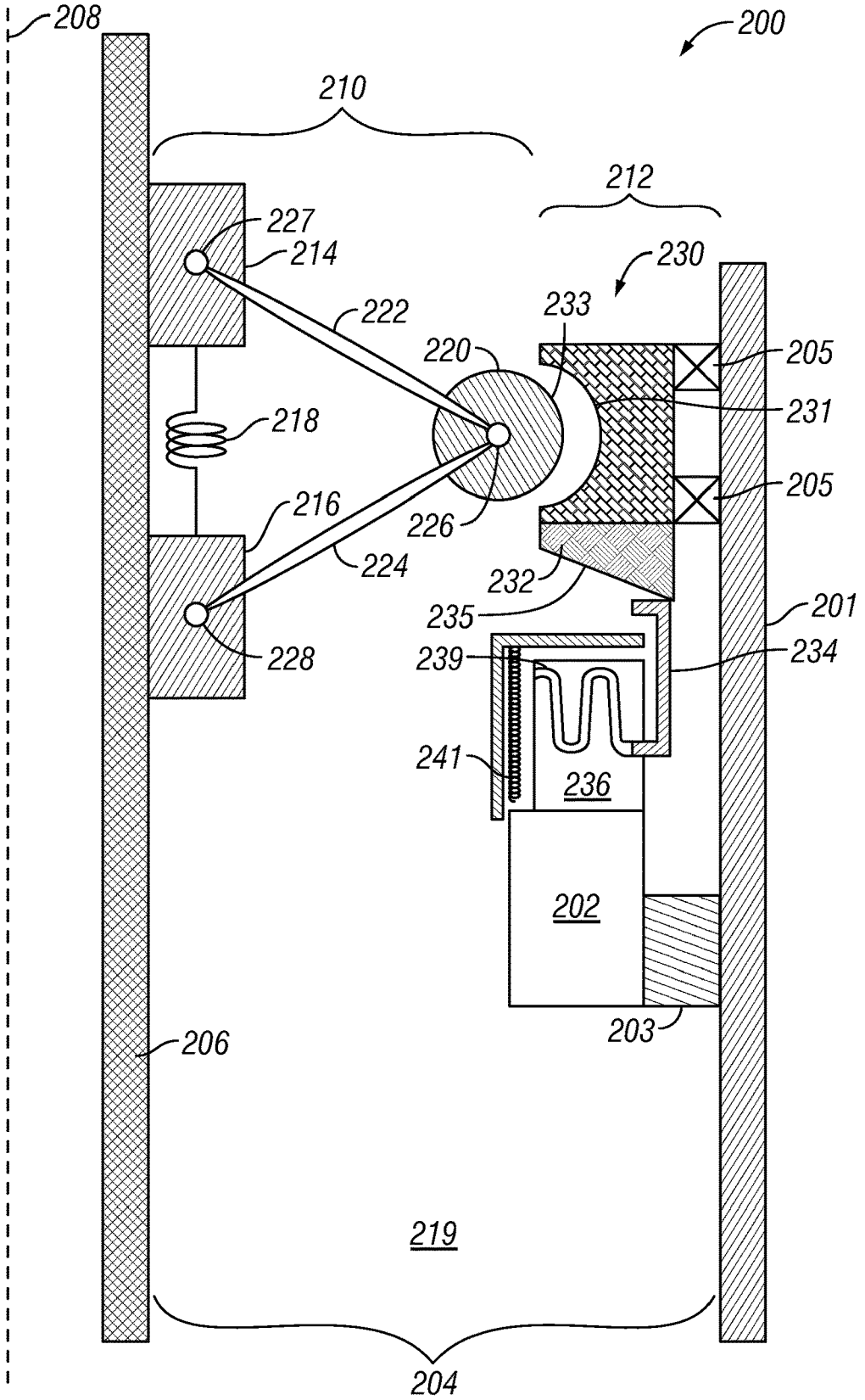
FIGS. 2A-2F depict schematic partial cross-sectional views of systems for controlling a component in accordance with one or more embodiments.
Figure 2B:
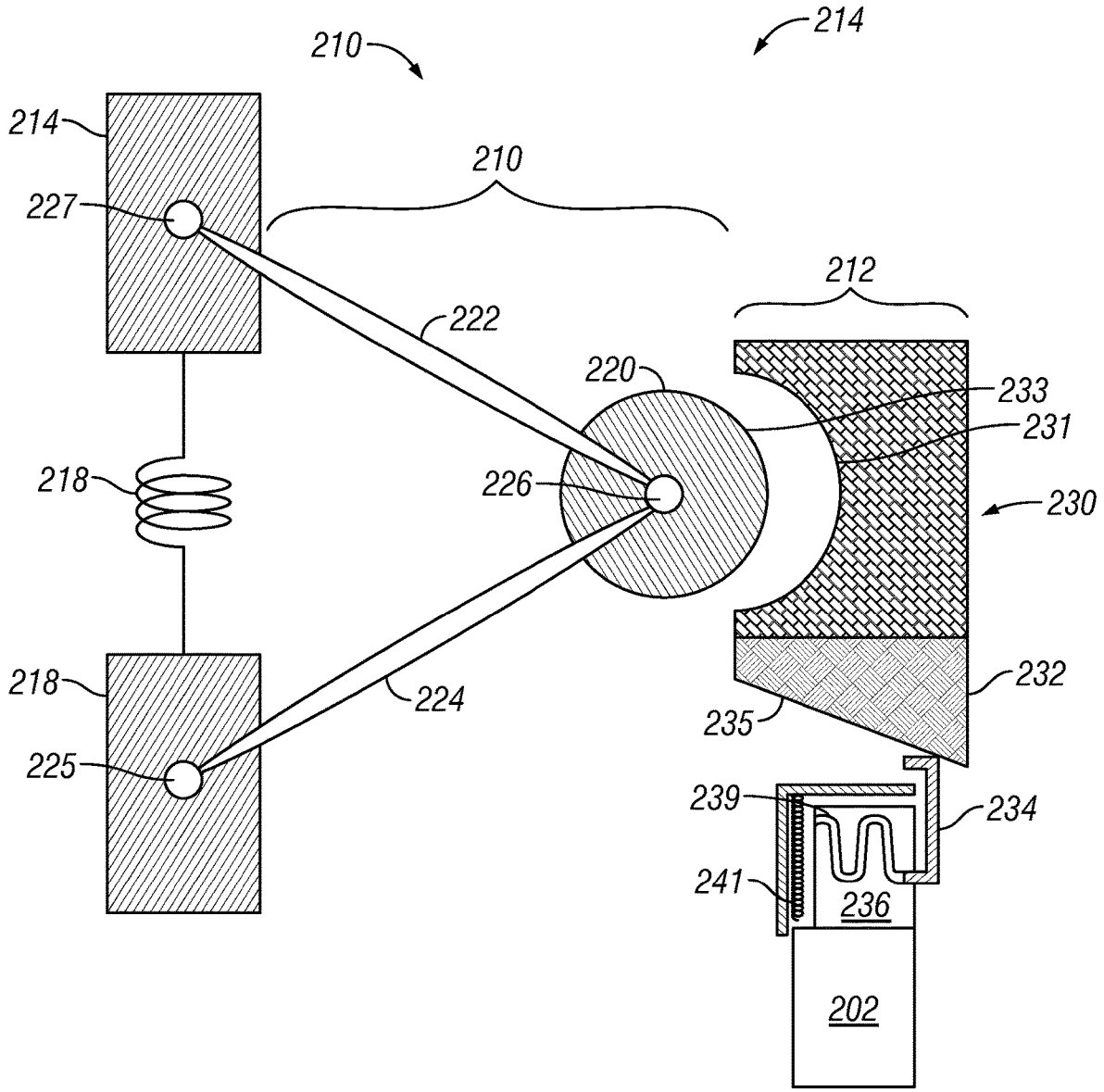
Figure 2C:
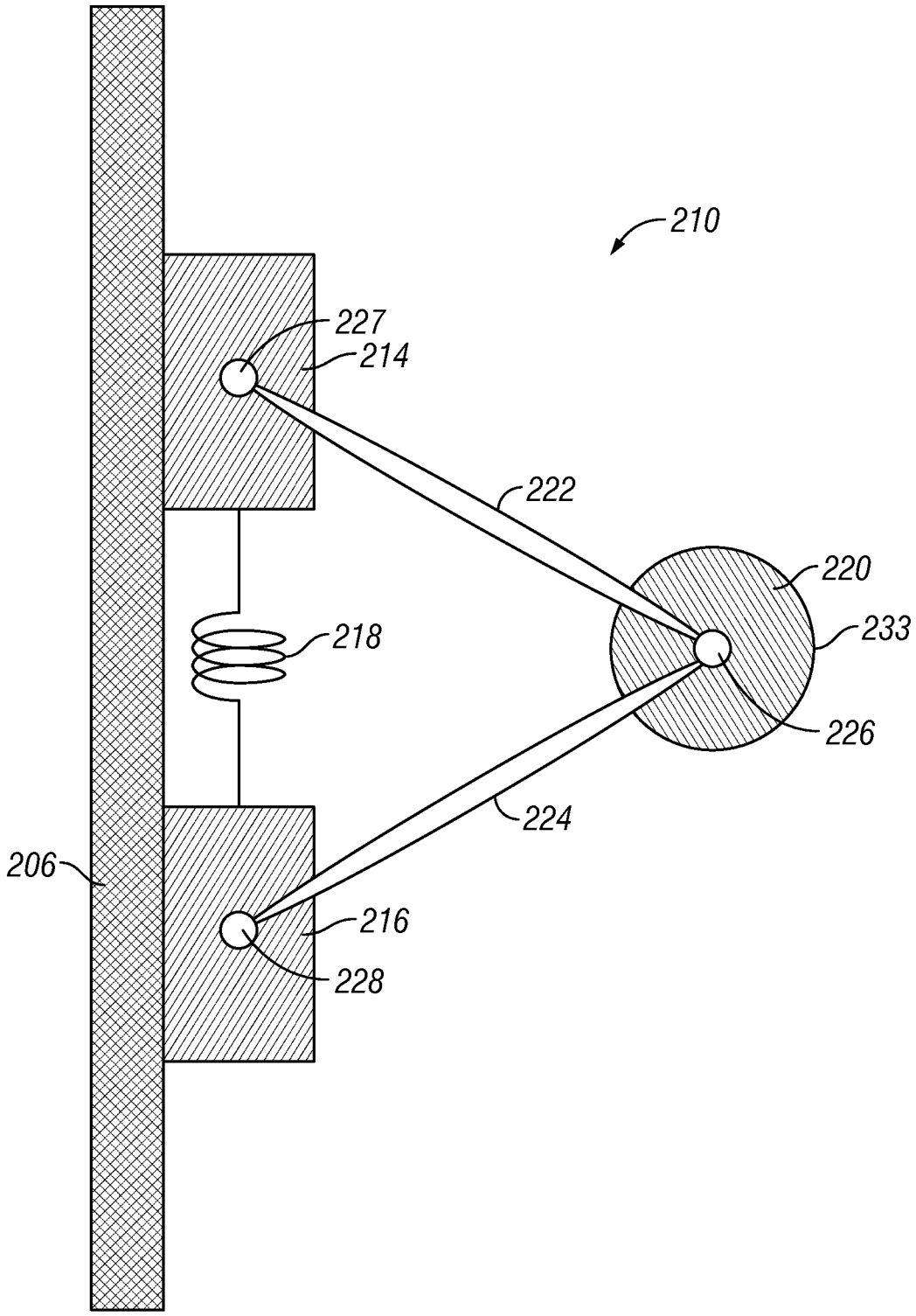
Figure 2D:
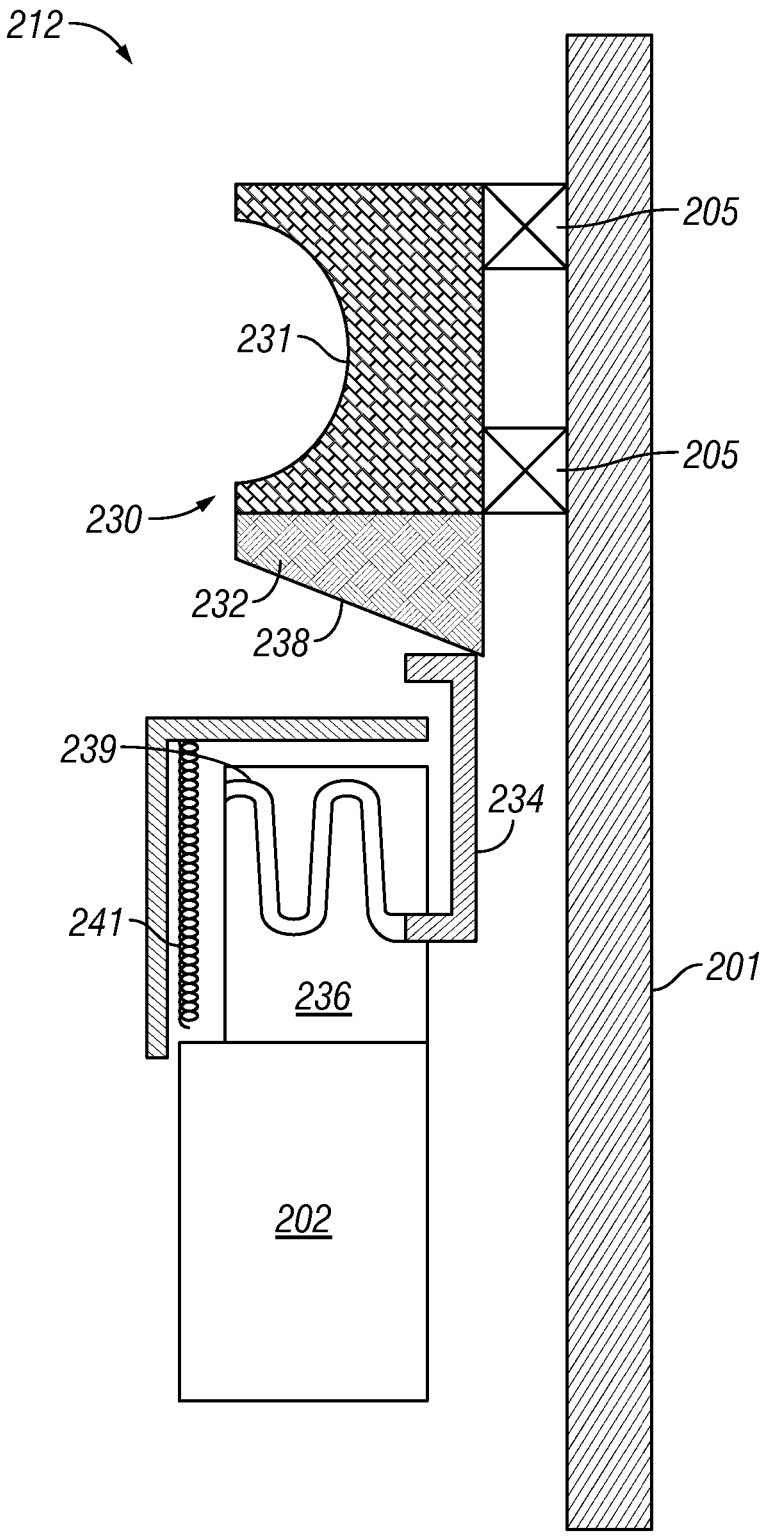
Figure 2E:
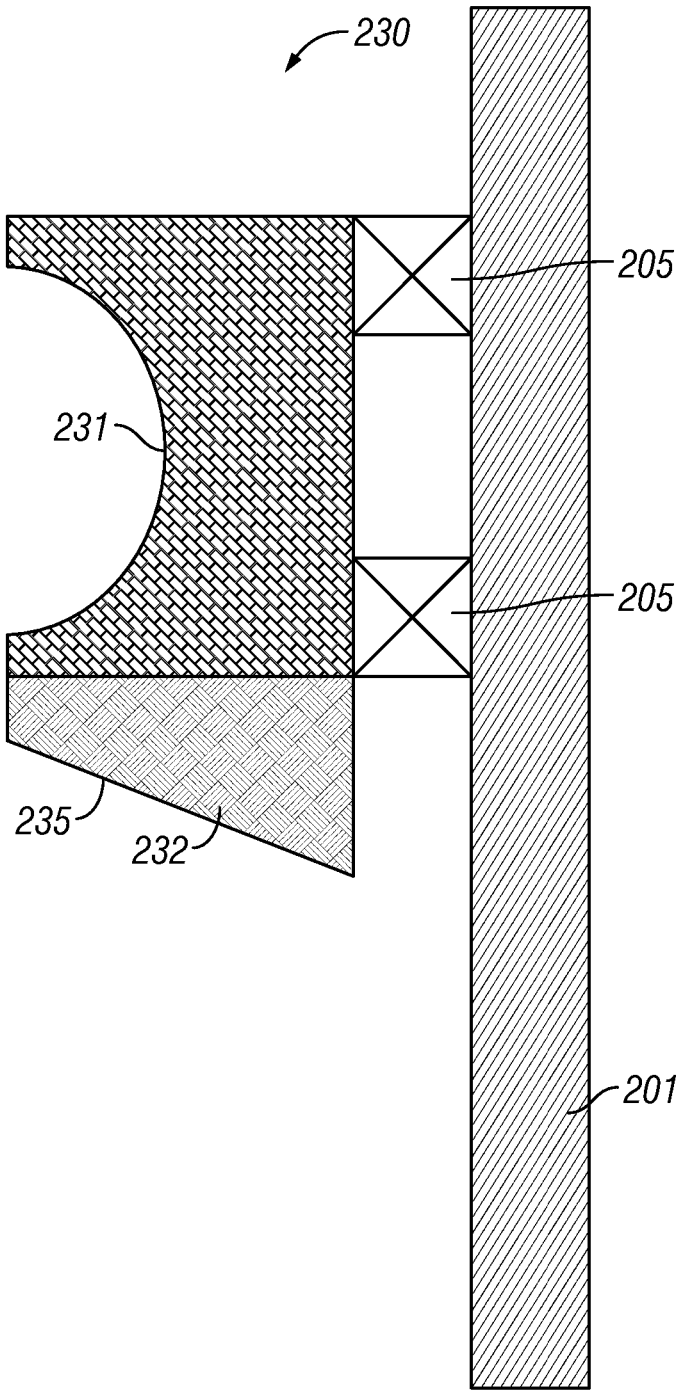

In one or more embodiments, the transfer assembly 204 (shown separately in FIG. 2B) includes a collar assembly 210 (shown separately in FIG. 2C) and a control assembly 212 (shown separately in FIG. 2D). The collar assembly 210 is coupled to the drill string 206, as shown in FIGS. 2A and 2C. The collar assembly 210 includes a stationary collar 214 coupled to a movable collar 216, each located in an annulus 219 between the drill string 206 and housing 201. The stationary collar 214 and movable collar 216 may be coupled together using a biasing mechanism 218 (e.g., a spring, a coil, etc.). The biasing mechanism 218 is configured to provide a force between the stationary collar 214 and the movable collar 216 in order to allow and/or restrict movement between the stationary collar 214 and the movable collar 216. For example, if the biasing mechanism 218 comprises a spring, the expansion and compression of the spring would allow movement between the stationary collar 214 and the movable collar 216.

In one or more embodiments, the movable collar 216 is configured to move axially along the drill string 206 relative to the stationary collar 214. For example, the stationary collar 214 may be threadably attached to the drill string 206 and as the drill string 206 rotates, the stationary collar 214 rotates with the drill string 206 about axis 208. The movable collar 216 is coupled to the drill string 206 and configured to move longitudinally (i.e., axially) along the drill string 206. For instance, the movable collar 216 may be movably located within a groove (not shown) of the drill string 206 and/or may be coupled to the drill string 206 using one or more bearings (not shown) that allow axial movement of the movable collar 216 with respect to the drill string 206. As the drill string 206 rotates, the collar assembly 210 engages the control assembly 212, as described further below.

As depicted in FIGS. 2A-2C, the collar assembly 210 includes a member 220 configured to engage with the control assembly 212. The member 220 may be an annular member that extends about axis 208 or may extend about only a portion of axis 208. The member 220 may be formed of any suitable material (e.g., an elastomeric member, a polymer member, a ceramic member, and/or a metal member). In one or more embodiments, the member 220 is coupled to the stationary collar 214 and the movable collar 216. For example, a stationary arm 222 may be rotatably coupled to the member 220 and the stationary collar 214. A movable arm 224 may be rotatably coupled to the member 220 and the movable collar 216. In one or more embodiments, an end of the stationary arm 222 may rotate about at least one of pivots 226 and 227 while an end of the movable arm 224 may rotate about at least one of pivots 226 and 228, as shown.

In one or more embodiments, when the drill string 206 rotates, the member 220 experiences a centrifugal force directed radially outward caused by rotation of the drill string 206. As the rotational speed of the drill string 206 increases, the centrifugal force experienced by the member 220 increases. Likewise, when the rotational speed of the drill string 206 decreases, the centrifugal force experienced by the member 220 decreases. Once the rotational speed of the drill string 206 exceeds a given threshold, the centrifugal force is capable of overcoming the force between the stationary collar 214 and the movable collar 216 caused by the biasing mechanism 218. At this point, the biasing mechanism 218 may compress and allow the movable collar 216 to move axially along the drill string 206 toward the stationary collar 214. Varying the rotational speed of the drill string 206 in turn varies the centrifugal force experienced by the components rotating with the drill string 206 causing a variation in radial motion of the member 220. In this example, the movable collar 216 is configured to move axially along the drill string 206, though it should be understood that both the stationary collar 214 and the movable collar 216 may be configured to move axially along the drill string 206. Alternatively, the stationary collar 214 may be configured to move axially along the drill string 206 while the movable collar 216 may be configured to be stationary.

Figure 2F:
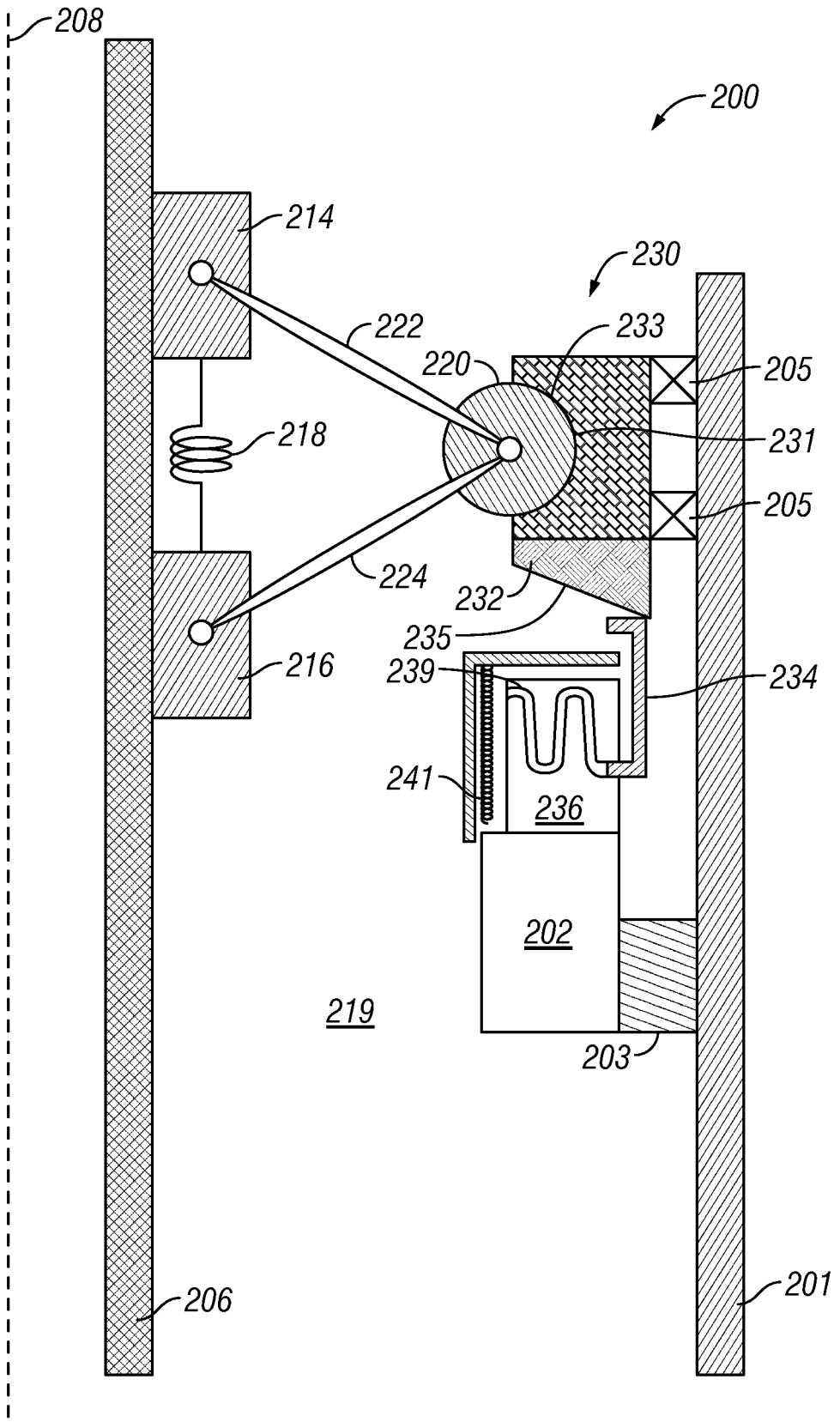

In one or more embodiments, as the member 220 extends radially outward, the member 220 engages a swash plate assembly 230 of the control assembly 212, as shown in FIG. 2F. The swash plate assembly 230 (shown separately in FIG. 2E) may include a profile 231 formed to correspond with a profile 233 of the member 220. For example, as depicted in FIG. 2B, the profile 233 of the member 220 is circular and the swash plate assembly 230 includes a semi-circular profile 231 corresponding to the circular profile 233 of the member 220. While a circular profile and corresponding profile are shown for the member 220 and the swash plate assembly 230, it should be understood that many profiles may be used without departing from the scope of the present disclosure. For example, the profile 233 of the member 220 and corresponding profile 231 of the swash plate assembly 230 may be elliptical, triangular, square, hexagonal, or be any other size and shape.

In one or more embodiments, the swash plate assembly 230 includes a swash plate 232 configured to engage a follower 234. When the member 220 engages with the swash plate assembly 230, the follower 234 may move along the swash plate 232 and control the component 202, for example, causing the component 202 to rotate. The follower 234 may move along the profile 235 of the swash plate 232 to actuate a valve, orient a toolface, adjust a sensor, or otherwise control component 202. As shown in FIG. 2B, a first end of the follower 234 may move in a forward and backward direction along a slanted side surface of the profile 235. A spring 241 can push the follower 234 onto the swash plate 232 and as the swash plate 232 rotates, the follower 234 may move axially based on the thickness of the swash plate 232. In some embodiments, the profile 235 of the swash plate 232 may be changed to control the movement of the follower 234 and/or the engagement of the follower 234 with the component 202.

The component 202 may be coupled to a slotted sleeve 236 that includes slots 239 along which the follower 234 may move within to control the component 202. As shown, the slots may be formed into a surface of the slotted sleeve 236 to provide a grooved surface. In one or more embodiments, a second end of the follower 234 may include a protruded portion, including an angular edge or a wheel, among others. The second end of the follower 234 can travel within the slots 239 and as the follower 234 rotates, the component 202 also rotates.

Figure 3:
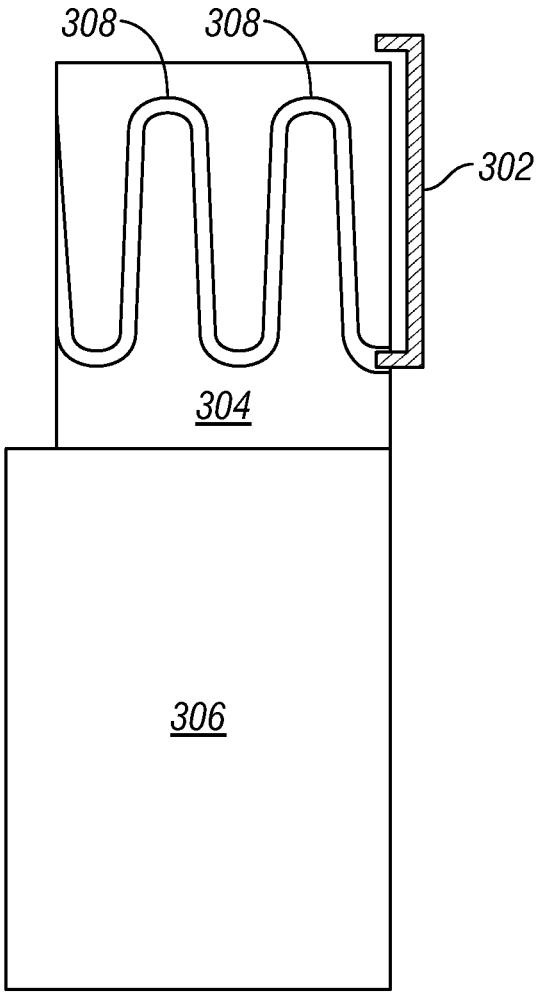
FIG. 3 depicts a profile view of a follower engaged with a slotted sleeve in accordance with one or more embodiments.

FIG. 3 depicts an example of a follower 302 engaged with a slotted sleeve 304 in accordance with one or more embodiments. As shown, the sleeve 304 may be coupled to a component 306 and may include grooved slots 308 that can extend into an external surface of the sleeve 304. In some embodiments, the follower 302 may act as a gear reduction as it travels through the slots 308. The follower 302 may engage with and/or travel within at least one of the slots 308 and thus, rotate the slotted sleeve 304. For every one revolution of a drill string, a slotted sleeve 304 with 100 slots will rotate 3.6 degrees (360 degrees/N, where N is the number of slots). In other words, for every 100 revolutions, the slotted sleeve 304 will rotate once. The component 306 may rotate as well since it is coupled to the sleeve 304. The component 306 may control of one or more additional components or operating parameters as it rotates. For instance, rotation of the component 306 may change a toolface orientation of another component or may actuate a valve to open or close a flow path (not shown).

Figure 4:
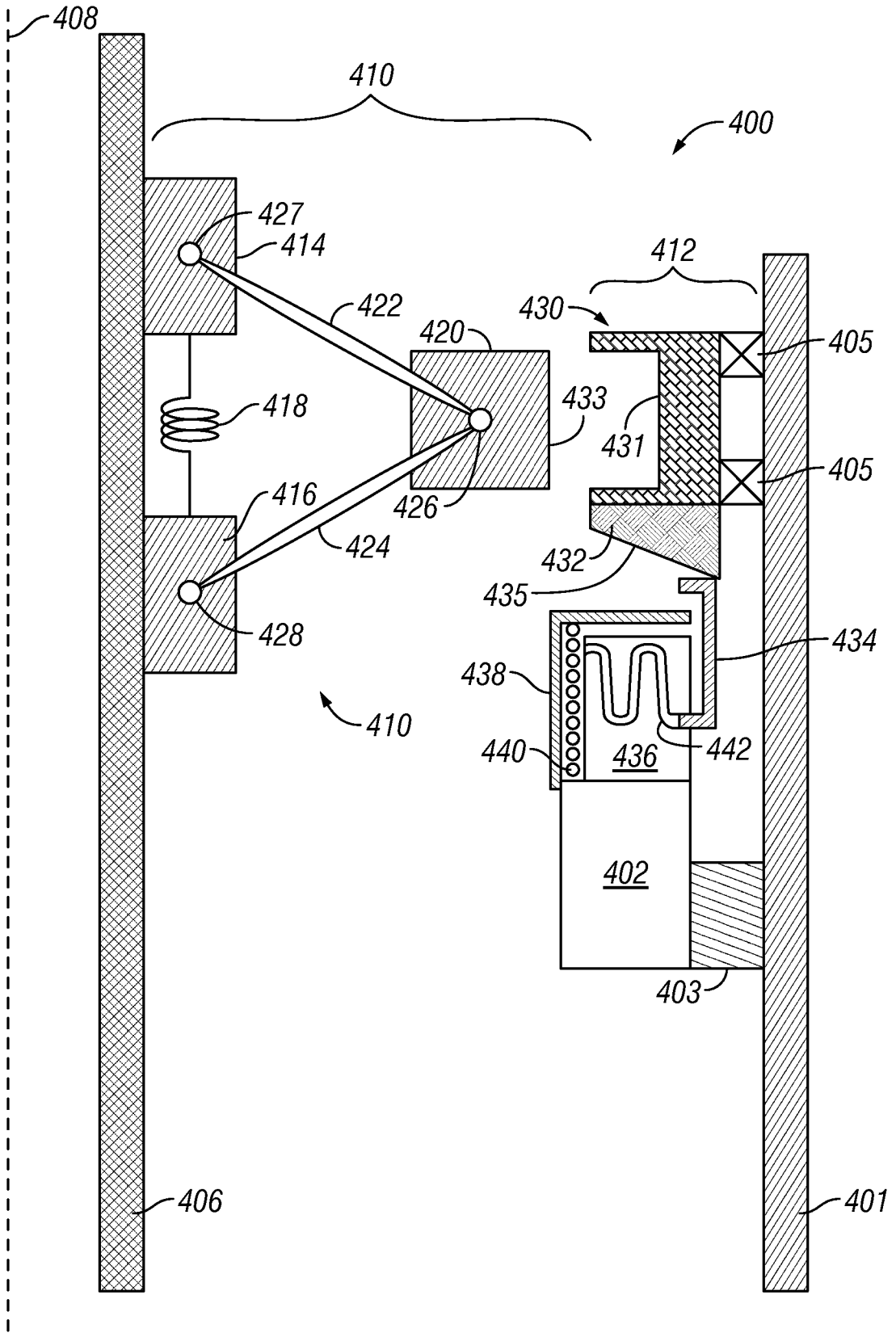
FIG. 4 depicts a schematic partial cross-sectional view of a system for controlling a component in accordance with one or more embodiments.

FIG. 4 depicts an example system 400 for controlling a component 402 in accordance with one or more embodiments. The system 400 includes a collar assembly 410 coupled to a drive shaft, such as a drill string 406 configured to rotate about axis 408. The collar assembly 410 includes a stationary collar 414 and a movable collar 416 coupled together using a biasing mechanism 418 configured to provide a force between the stationary collar 414 and the movable collar 416 in order to allow and/or restrict movement between the stationary collar 414 and the movable collar 416. The collar assembly 410 is configured to engage with a control assembly 412 having a swash plate assembly 430.

As shown, the collar assembly 410 also includes a member 420 having a square cross-sectional profile 433. To engage with the member 420, the swash plate assembly 430 includes a corresponding square profile 431 of the same size and shape as the profile 433 of member 420. In one or more embodiments, a follower 434 of the swash plate assembly 430 may be configured to engage with swash plate 432, the component 402, and an engagement member 438. The engagement member 438 may be coupled to the component 402 using a biasing member 440 (e.g., a spring, a coil). The engagement member 438 may be configured to urge and/or force the follower 434 along a profile 435 of the swash plate 432. As the member 420 engages with the swash plate assembly 430, rotation of the drill string 406 causes the follower 434 to travel along the profile 435 of the swash plate 232. As the drill string 406 rotates, the biasing member 440 expands and contracts in order to maintain contact between the follower 434 and the swash plate 432. A sleeve 436 may be coupled to the component 402 and may include grooved slots 442 created at an external surface of the sleeve 436. In some embodiments, the follower 434 may act as a gear reduction as it travels through the slots 442. Accordingly, as the follower 434 travels within the slots 442 and as the follower 434 rotates, the component 402 and the sleeve 436 also rotates.

Although not shown, it should be understood that other configurations of the transfer assembly may be used in one or more embodiments without departing from the scope of the present disclosure. For example, the transfer assembly may be arranged such that decreasing a rotational speed of the drill string may control the component. In addition, biasing mechanisms may also be provided within or instead of stationary arm and movable arm in order to further control the engagement of the annular member with the swash plate assembly.

In accordance with one or more embodiments of the present disclosure, a transfer assembly may be selectively used to control a downhole component using rotation of a drive shaft, such as a drill string, tubular, or any other member configured to rotate. As engagement of a member of a collar assembly with a control assembly depends on the rotational speed of the drive shaft coupled to the collar assembly, the component may be selectively controlled. For example, by increasing the rotational speed of the drive shaft, the component may be actuated, rotated, adjusted, or otherwise controlled using the transfer assembly. Further, controlling the downhole component may include at least one of actuating a valve, rotating a sleeve, orienting a toolface, and adjusting a sensor direction, among others.

As mentioned above, it should be understood that decreasing the rotational speed of the drive shaft may also be used to control one or more components. For simplicity only a single downhole component has been shown and described herein. It should also be appreciated that two or more components may be controlled using the systems and methods of the present disclosure. Similarly, other elements may be included in the system in order to control one or more components. Some elements described herein may also be excluded from the system in order to control one or more components. Those having ordinary skill in the art would appreciate that many other components and configurations may be considered without departing from the scope of the present disclosure.

In addition to the embodiments described above, many examples of specific combinations are within the scope of the disclosure, some of which are detailed below:

Example 1. A system for controlling a downhole component within a borehole, the system comprising: a transfer assembly comprising a swash plate assembly configured to control the downhole component and a member configured to engage the swash plate assembly; and wherein the member is configured to move radially based upon a rotational speed of a rotatable component in the borehole to selectively engage the swash plate assembly.

Example 2. The system of Example 1, wherein the swash plate assembly comprises a swash plate configured to engage the downhole component.

Example 3. The system of Example 2, wherein the swash plate is coupled to a follower configured to engage a sleeve of the downhole component.

Example 4. The system of Example 3, wherein the follower is configured to engage at least one of a plurality of slots of the sleeve to actuate the downhole component.

Example 5. The system of Example 4, wherein the sleeve comprises a ratcheting mechanism configured to move as the follower moves along at least one of the plurality of slots.

Example 6. The system of Example 4, wherein the sleeve comprises a rotating sleeve configured to rotate when the follower slides along at least one of the plurality of slots.

Example 7. The system of Example 1, wherein the transfer assembly further comprises a collar assembly coupled to the rotatable component, the collar assembly comprising a biasing mechanism coupled between a stationary collar and a movable collar and configured to apply a force between the stationary collar and the movable collar.

Example 8. The system of Example 7, wherein one of the stationary collar and the movable collar is configured to move along an axis of the rotatable component based upon a centrifugal force experienced by the member and caused by rotation of the rotatable component.

Example 9. The system of Example 7, wherein the collar assembly further comprises a stationary arm coupled between the annular member and the stationary collar and a movable arm coupled between the annular member and the movable collar.

Example 10. The system of Example 9, wherein the annular member engages the swash plate assembly when at least one of the stationary collar and the movable collar moves axially along the rotatable component.

Example 11. The system of claim 9, wherein the annular member engages the swash plate assembly as one of the stationary collar and the movable collar moves along the drill string while the other of the stationary collar and the movable collar remains stationary with respect to the rotatable component.

Example 12. A drilling system for drilling a borehole, the system comprising: a rotatable component located within the borehole and configured to extend the borehole; a transfer assembly coupled between the rotatable component and a downhole component, the transfer assembly comprising a swash plate assembly configured to control the downhole component and a member configured to engage the swash plate assembly; and wherein the member is configured to move radially based upon a rotational speed of the rotatable component to selectively engage the swash plate assembly.

Example 13. The drilling system of Example 12, wherein the swash plate assembly comprises a swash plate coupled to a follower configured to engage the downhole component.

Example 14. The drilling system of Example 12, wherein the transfer assembly further comprises a collar assembly comprising the member, a stationary collar, and a movable collar coupled together.

Example 15. The drilling system of Example 14, wherein a stationary arm couples the member to the stationary collar and a movable arm couples the annular member to the movable collar.

Example 16. The transfer assembly of claim 14, further comprising a biasing mechanism coupled between the stationary collar and the movable collar.

Example 17. A method of controlling a downhole component, the method comprising: rotating a rotatable component located within a borehole; radially moving a member of a transfer assembly based upon a rotational speed of the rotatable component to selectively engage a control assembly; and controlling the downhole component using the control assembly.

Example 18. The method of Example 17, wherein radially moving the member of the transfer assembly comprises engaging the member with a swash plate assembly of the control assembly by extending the member into engagement with a swash plate of the swash plate assembly by increasing rotational speed of the rotatable component.

Example 19. The method of Example 17, wherein controlling the downhole component comprises moving a follower coupled to a swash plate of the swash plate assembly along at least one of a plurality of slots of a sleeve of the downhole component.

Example 20. The method of Example 17, wherein controlling the downhole component comprises at least one of actuating a valve, rotating a sleeve, orienting a toolface, and adjusting a sensor direction.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

We claim:

1. A system for controlling a downhole component within a borehole, the system comprising:

a transfer assembly comprising a swash plate assembly configured to control the downhole component and a member configured to engage the swash plate assembly;

a rotatable component rotatable within the borehole; and wherein the member is configured to rotate with and move radially based upon a speed of rotation of the rotatable component to selectively engage the swash plate assembly.

2. The system of claim 1, wherein the swash plate assembly comprises a swash plate configured to engage the downhole component.

3. The system of claim 2, wherein the swash plate is coupled to a follower configured to engage a sleeve of the downhole component.

4. The system of claim 3, wherein the follower is configured to engage at least one of a plurality of slots of the sleeve to actuate the downhole component.

5. The system of claim 4, wherein the sleeve comprises a ratcheting mechanism configured to move as the follower moves along at least one of the plurality of slots.

6. The system of claim 4, wherein the sleeve comprises a rotating sleeve configured to rotate when the follower slides along at least one of the plurality of slots.

7. The system of claim 1, wherein the transfer assembly further comprises a collar assembly coupled to the rotatable component, the collar assembly comprising a biasing mechanism coupled between a stationary collar and a movable collar and configured to apply a force between the stationary collar and the movable collar.

8. The system of claim 7, wherein one of the stationary collar and the movable collar is configured to move along an axis of the rotatable component based upon a centrifugal force experienced by the member and caused by rotation of the rotatable component.

9. The system of claim 7, wherein the collar assembly further comprises a stationary arm coupled between the annular member and the stationary collar and a movable arm coupled between the annular member and the movable collar.

10. The system of claim 9, wherein the annular member engages the swash plate assembly when at least one of the stationary collar and the movable collar moves axially along the rotatable component.

11. The system of claim 9, wherein the annular member engages the swash plate assembly as one of the stationary collar and the movable collar moves along the rotatable components while the other of the stationary collar and the movable collar remains stationary with respect to the rotatable component.

12. A drilling system for drilling a borehole, the system comprising:

a rotatable component rotatable within the borehole and configured to extend the borehole;

a transfer assembly coupled between the rotatable component and a downhole component, the transfer assembly comprising a swash plate assembly configured to control the downhole component and a member configured to engage the swash plate assembly; and wherein the member is configured to rotate with and move radially based upon a speed of rotation of the rotatable component to selectively engage the swash plate assembly.

13. The drilling system of claim 12, wherein the swash plate assembly comprises a swash plate coupled to a follower configured to engage the downhole component.

14. The drilling system of claim 12, wherein the transfer assembly further comprises a collar assembly comprising the member, a stationary collar, and a movable collar coupled together.

15. The drilling system of claim 14, wherein a stationary arm couples the member to the stationary collar and a movable arm couples the annular member to the movable collar.

16. The transfer assembly of claim 14, further comprising a biasing mechanism coupled between the stationary collar and the movable collar.

17. A method of controlling a downhole component, the method comprising:

rotating a rotatable component within a borehole;

rotating a member of a transfer assembly with the rotatable component;

radially moving the member of the transfer assembly based upon a speed of rotation of the rotatable component to selectively engage a control assembly; and controlling the downhole component using the control assembly.

18. The method of claim 17, wherein radially moving the member of the transfer assembly comprises engaging the member with a swash plate assembly of the control assembly by extending the member into engagement with a swash plate of the swash plate assembly by increasing rotational speed of the rotatable component.

19. The method of claim 17, wherein controlling the downhole component comprises moving a follower coupled to a swash plate of the swash plate assembly along at least one of a plurality of slots of a sleeve of the downhole component.

20. The method of claim 17, wherein controlling the downhole component comprises at least one of actuating a valve, rotating a sleeve, orienting a toolface, and adjusting a sensor direction.

* * * * *